US005335532A

United States Patent [19]

Mueller et al.

[11] Patent Number: 5,335,532

[45] Date of Patent: Aug. 9, 1994

[54] BODY MAKER APPARATUS

[75] Inventors: Peter M. Mueller, Littleton; Robert J. Schreiner, Commerce City, both of Colo.

[73] Assignee: Aluminum Company of America, Pittsburgh, Pa.

[21] Appl. No.: 899,201

[22] Filed: Jun. 16, 1992

[51] Int. Cl.[5] ..... B21J 9/18; B21J 9/20; B30B 1/06

[52] U.S. Cl. ..... 72/450; 72/452; 100/282; 74/603

[58] Field of Search ..... 72/450, 451, 452; 100/282, 292; 74/603, 540

[56] References Cited

U.S. PATENT DOCUMENTS 3,450,038 6/1969 Kraft et al. ..... 100/282
3,611,918 10/1971 Marsh et al. ..... 72/450
3,696,657 10/1972 Maytag ..... 72/450
4,674,357 6/1987 Sugawara et al. ..... 100/282
4,757,734 7/1988 Portman ..... 100/282
4,819,593 4/1989 Bruener et al. ..... 74/603
5,052,257 10/1991 Eigenman ..... 74/603
5,138,922 8/1992 Eigenman ..... 74/603

*Primary Examiner*—David Jones
*Attorney, Agent, or Firm*—Thomas R. Trempus

[57] ABSTRACT

Both a method and an apparatus for the reduction of the load magnitudes present during the operation of a can body maker apparatus are provided through the use of a counterbalance mass structure system. A counterbalance structure is operatively associated with the crankshaft which motivates the can body maker ram assembly so that as the ram assembly is reciprocated along a straight line path during the formation of can bodies, the counterbalance structure is reciprocated to compensate for both the straight line (X axis) motion of the ram assembly as well as motion perpendicular thereto.

18 Claims, 4 Drawing Sheets

BODY MAKER APPARATUS

FIELD OF THE INVENTION

This invention relates generally to can body makers and more particularly to the ram drive assembly in which circular motion of a crankshaft is translated into reciprocating straight line motion in the ram assembly wherein the improvement is a counterbalance mass system which substantially eliminates the load magnitudes which generate excessive vibration and wear in body makers.

BACKGROUND OF THE INVENTION

A can body maker apparatus is disclosed in U.S. Pat. No. 3,696,659, issued to J. H. Maytag and an improvement to the ram assembly of the can body maker ram assembly is disclosed in U.S. Pat. No. 4,934,169, issued to C. M. Grimes, et al Both of these patents which are assigned to Adolph Coors Company are incorporated herein by reference as if fully set forth.

Can body makers produce elongated can bodies from can shells at a rate of approximately 200 can bodies per minute. The can shells have a wall thickness of approximately 0.009 to 0.012 inch, and the elongated can bodies have a wall thickness of approximately 0.0045 inch. In a can body maker apparatus, as generally shown in the Maytag patent, a ram is movably mounted for reciprocal, straight line motion at rates sufficient to form from between 180 and 220 can bodies per minute. The stroke length, that is the distance traveled by the movable ram, is between about 18 to 26 inches. As a general rule, for a given can body maker, the shorter the ram stroke, the greater the rate or number of cycles per minute at which the ram can be operated. Misalignment as small as between about 0.0005 and 0.0010 inch can result in the formation of defective cans. The high speed, constant reciprocating movement of the ram assembly of a can body maker at up to 11,000 pounds of force creates extreme load magnitudes within the machine itself as well as in the floor on which the machine is mounted, not to mention the surrounding manufacturing facility. Such extreme load magnitudes create high levels of vibrations and contribute to the wear of all moving components within the machine.

As a result of the vibration generated by the ram assembly, efforts in the industry have been directed to developing new techniques for maintaining the ram assembly in alignment relative to the dies used to form the can bodies. As illustrated in the patents referenced above, ram carriage assemblies which were mounted for reciprocal movement on track and wheel arrangements typically have been replaced with fluid bearing support structures to minimize misalignment of the ram relative to the can body maker dies. Nonetheless, while alignment of the ram relative to the die is maintained within acceptable tolerances, the high speed reciprocal motion at rates of approximately 200 cycles per minute continues to generate extreme vibrations within the frame structure of the body maker apparatus as well as in the area surrounding the body maker.

SUMMARY OF THE INVENTION

Both a method and an apparatus for the reduction of the unbalanced forces and vibrations resulting from the load magnitudes present during the operation of a can body maker apparatus are provided through the use of a counterbalance mass structure system. A counterbalance structure is operatively associated with the crankshaft which motivates the can body maker ram assembly so that as the ram assembly is reciprocated along a straight line path during the formation of can bodies, the counterbalance structure is reciprocated to compensate for both the straight line (X axis) motion of the ram assembly as well as motion (Y and Z axes) which is perpendicular to the ram assembly motion.

The counterbalance system is designed for incorporation either during the manufacture of new can body makers or into existing can body makers as a retrofitted accessory. Generally, can body makers include a frame which supports a drive mechanism including a crank which rotates about a first axis mounted in the frame. The drive mechanism crankshaft is connected by a rod to a ram assembly which is reciprocally motivated in a straight line motion for forming can blanks or shells into elongated can bodies. A teardrop member is rotatably mounted on the crankshaft for eccentric rotation relative to the first axis about which the crankshaft rotates. The teardrop member has a first pivot point thereon to which is connected a counterbalance mass structure. The mass structure is disposed for reciprocal motion relative to a predetermined reference point in the frame of the body maker. The reciprocal motion is preferably substantially parallel to and opposite the ram assembly motion with some lesser component of motion thereof perpendicular to the ram assembly. The motion of the counterbalance structure can be either straight line reciprocating motion or, as shown in the preferred embodiment, reciprocal motion about a pivot point to provide a substantial parallel motion augmented by a lesser perpendicular motion.

It is an object of this invention to provide an improved can body maker with a counterbalance system, as well as a counterbalance system adaptable for retrofitting onto existing can body makers.

It is another object of this invention to substantially eliminate potential misalignment between the die and punch in can body makers resulting from the force induced vibrations in relatively high speed can body makers.

It is yet another object of this invention to increase the speed at which body makers can effectively operate.

It is a further object of this invention to provide a method and an apparatus for reducing stresses caused by the load magnitudes seen in the floor machine interface of can body makers.

It is also an object of this invention to provide a can body apparatus capable of consistently producing a can body formed to precise tolerances and substantially reduce the manufacture of defective cans.

It is yet another object of this invention to improve can body makers so as to facilitate the manufacture of elongated can bodies having thinner side walls.

BRIEF DESCRIPTION OF THE DRAWINGS

The above as well as other features and advantages of the invention can be more fully appreciated through consideration of the detailed description of the invention in conjunction with the several drawings in which.

DETAILED DESCRIPTION OF A PREFERRED EMBODIMENT

Figure 1:
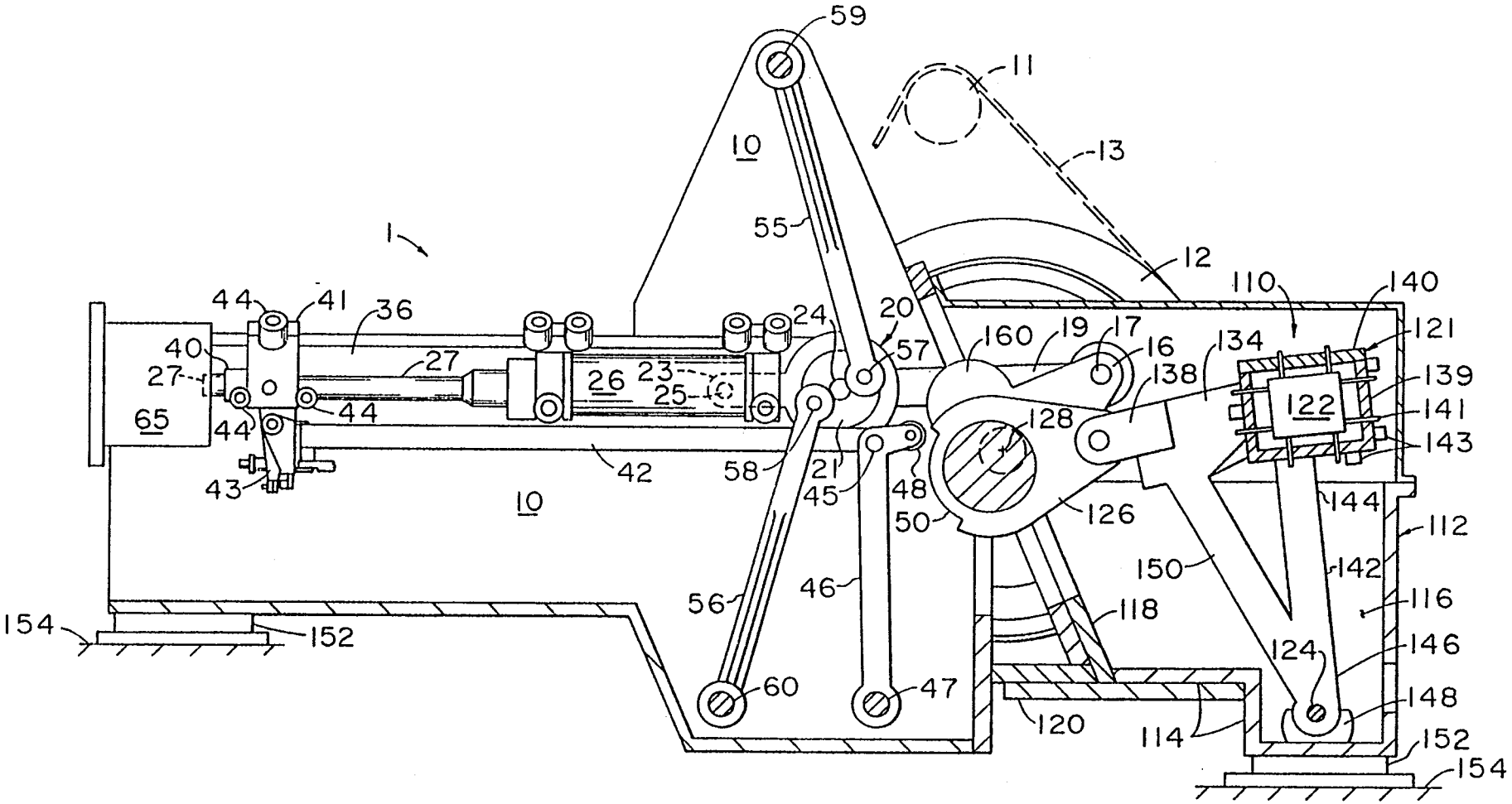
FIG. 1 is an elevational side view of a can body making apparatus showing a ram assembly on the left side of the apparatus, a motor and pulley wheel near the center of the apparatus, and the counterbalance system of this invention with sections cut-away, proximate the motor and pulley and extending to the right side of the apparatus.

In order to fully appreciate the counterbalance mass system of this invention, it is critical to understand first the operation of a typical can body maker apparatus. Turning now to FIG. 1, a can body maker is generally indicated by the reference character 1. The can body maker 1 is represented in the left-hand portion of FIG. 1 and includes a frame 10 having mounted thereon a motor 11 which drives a large pulley wheel 12 by belts 13. The pulley 12 is fixedly mounted on one of a pair of transversely extending axially aligned crankshafts 15 with crank arms 16. The shafts 15 are rotatable in bearing 15' mounted in opposite sides of the frame 10. The crank arms 16 are connected together by a crank pin 17 extending through the bearings 18 of a main connecting rod 19 which terminates at its other end in two parallel transversely spaced apart arms for engaging the circumferential surfaces of a cross head member 21, which is part of the straight line motion assembly designated 20. The pivotal point of the assembly is designated 24. The member 21 is engaged circumferentially by the end of a carriage connecting rod 23 by the connecting rod 19. The carriage connecting rod 23 is pivotally connected at its other end by a pin 25 to a ram assembly 26, in which is mounted a ram or punch 27.

The ram assembly 26 is mounted for reciprocal movement according to any number of techniques known in the art of can body makers. The specific mounting method is not critical to the application of the instant counterbalance mass system. The patents to Maytag and Grimes illustrate two typical mounting methods, wheeled carriage, as also shown in FIG. 1, and fluid bearings, respectively.

A redraw sleeve 40 is slidable on the forward portion of the ram 27 and is fastened at its rearward end to a redraw carriage 41. The latter can be connected at either one side, as shown here, or at both of its sides, to an elongated redraw sleeve actuating bar 42 parallel to the ram 27 and movable in longitudinal, or X axis, direction independently of the ram. The redraw carriage 41 has pivotally connected thereto a downwardly directed rocker arm 43 provided with rollers 44 which travel on the carriage way strips 36. Each bar 42 is pivotally connected at its rearward end 45 to a cam follower lever 46 which has its lower end mounted on a fixed pivot 47 on the frame 10 and has on its upper end a laterally extending arm shaped to provide a cam follower 48 for contacting a cam surface as at 50 which will be discussed in detail below.

The straight line motion assembly 20 includes a side thrust resisting, upper swing lever 55 and lower swing lever 56, both bifurcated at their inner ends so as to straddle the cross head member 21. The upper swing lever 55 is pivotally connected to the cross head member 21, as indicated at 57, and the lower swing lever 56 is pivotally connected at 58 to the cross head member 21. The upper end of the upper swing lever 55 is pivotally connected to the fixed pivots 59 on frame members 10, and the lower end of the lower swing lever 56 is pivotally connected to the fixed pivots 60 on frame members 10.

A tool pack housing 65, in a can body making machine, encloses a series of drawing and ironing dies (not shown) through which a workpiece such as a cup (not shown) is pushed by the ram 27.

The redraw sleeve 40 and actuating bar 42 receive their forward moving power from the rotated cam surface, as at 50, imparted to the cam followers 48 on levers 46. A return mechanism (not shown) for imparting rearward movement to the redraw sleeve 40 and actuating bars 42 typically comprises an air cylinder mounted on a support and a piston rod connected to the bar 42. The air cylinder maintains contact between the cam followers 48 and the cam face. In operation, the can body maker, motor 11 drives the pulley wheel 12 through belts 13; pulley wheel 12 rotates the crankshafts 15 and thereby rotates the crank arm 16 connected by crank pin 17. Rotation of the crankshafts 15 and arms 16 rotates the cam surface 50.

To move the ram 27 in axial direction toward the tool pack housing 65, the crank arms 16 and connecting pin 17 move bodily in a circular path around the axis of the shaft 15 and move the connecting rod 19, the straight line motion assembly 20, carriage connecting rod 23, ram carriage 26 and ram 27 from the retracted position of FIG. 1 to a partially extended position, and then to the fully extended position. After the ram 27 has passed through the tool pack housing 65, continued movement of the reciprocating mechanism causes the ram to be retraced finally to the retracted position of FIG. 1.

At the same time, the redraw sleeve 40 is actuated by the cam 50 rotated by cranks 15. The cam surface 50 is engaged by the cam follower 48 on levers 46 connected pivotally at 45 to actuating bars 42. The sleeve 40 is thereby moved from its retracted position, to the fully extended position, where its motion is arrested by contact of the workpiece (carried by the sleeve 40) with the face of the tool pack 65.

During the described movement of the connecting rod 19, regardless of its varying extreme angular positions relatively to the carriage-mounted ram, side or vertical thrust is reduced by the three link cross head assembly comprising the member 21 and the levers 55, 56 pivotally connected to the cross head assembly by parallel pivot pins 57, 58 respectively, which extend through the ends of the levers and through the cross head member in positions diametrically equally spaced from the pivotal point 24 of the assembly, whereby straight line motion is imparted to the carriage 26 and ram 27. However, some side thrust or motion remains present during the operation of the ram assembly.

The counterbalance system of the present invention can be incorporated as an integral feature of a newly manufactured can body apparatus or it can be retrofitted onto an existing can body maker which employs a reciprocating ram assembly. It will be readily appreciated by those skilled in the art of body makers that when retrofitting an existing can body maker, the crankshaft is removed and replaced with a modified crankshaft configured to support the connecting linkage of the counterbalance system, while in a newly manufactured system, a modified crankshaft assembly is incorporated during manufacture.

As an overview, the counterbalance system is shown in FIG. 1 and generally indicated by the reference character 110. A support housing 112 includes a bottom portion 114, opposing side portions as at 116, and a front interface portion 118 which forms the interface with the frame when retrofitting an existing body maker with a counterbalance system. Additional structural support such as at 120 may be employed when retrofitting the counterbalance system onto an existing body maker. A counterbalance structure generally indicated at 121 and shown in FIG. 4, includes a counterbalance mass 122. The counterbalance structure 121, which will be described in detail below, is mounted for reciprocal movement within the housing 112 relative to a first reference point 124. The reciprocal movement of the counterbalance mass 122 preferably contains a substantial horizontal or X axis component which is substantially parallel with the reciprocating motion of the ram assembly. Additionally, the reciprocal movement of the counterbalance can include a slight vertical or Y axis component to dampen the slight vertical movement of the ram assembly drive mechanism lever arms and crankshaft as described above. Accordingly, while a pivoting, reciprocating mass structure is shown in the preferred embodiment, a straight line reciprocating structure slidable along a rail system can be employed. In the preferred embodiment of the invention, the counterbalance mass 122 includes a slight Y axis component in its movement as the result of the mounting method selected to provide the desired X axis component.

Figure 2:
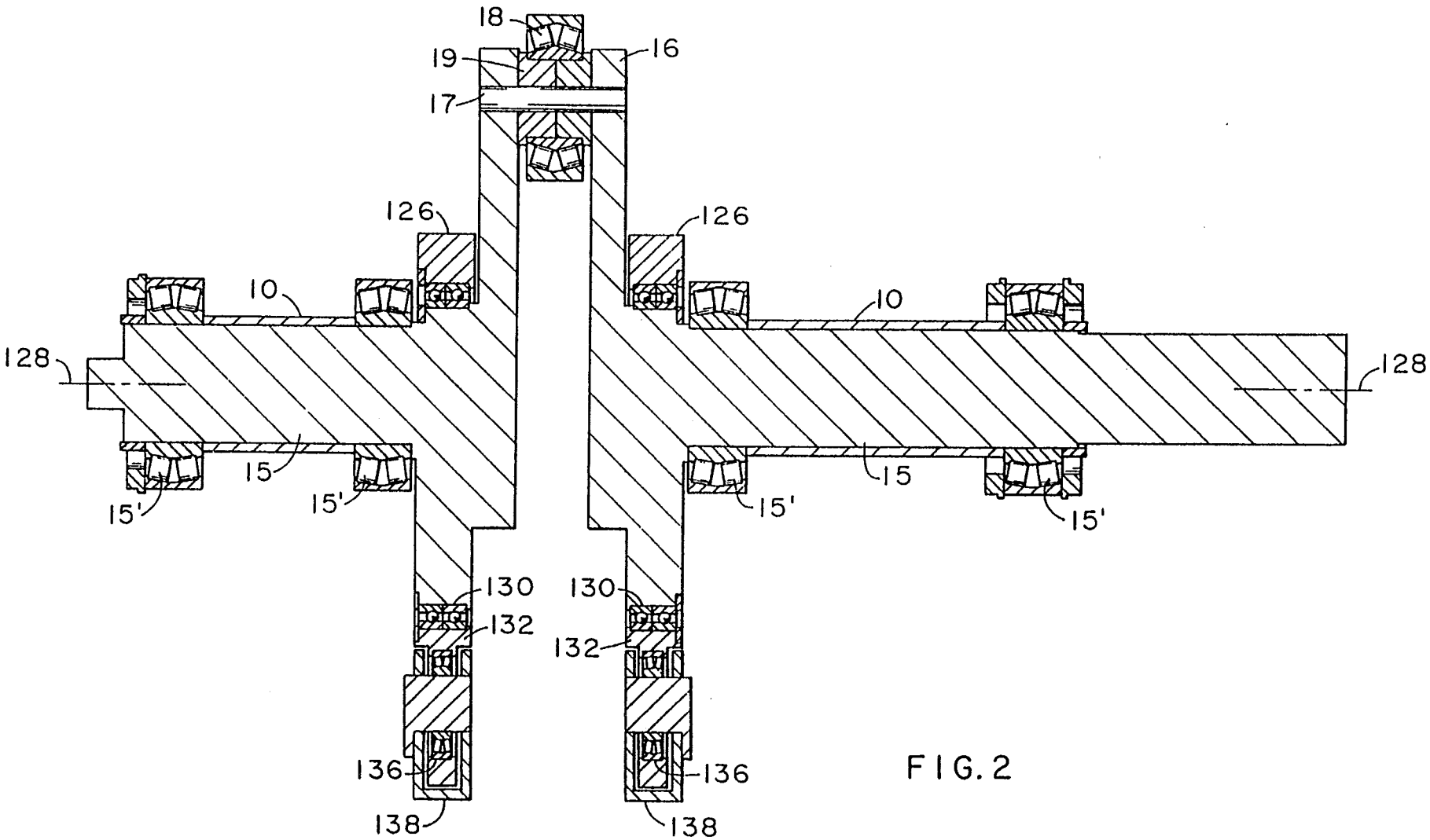
FIG. 2 is a cross-sectional, top plan view of a crankshaft and teardrop drive member, all according to the teaching of this invention.

Considering also FIG. 2, a teardrop shaped drive member 126 is rotatably mounted for eccentric movement about the crankshaft 15 axis of rotation 128. Suitable bearings are provided as at 130 to rotatably support the teardrop member 126 about the crankshaft. As the crankshaft rotates about the axis 128 to motivate the ram assembly, the teardrop member is rotated eccentrically about the axis 128 to effect reciprocal movement of the lobe portion 132 of the teardrop 126 relative to the crankshaft axis of rotation. A connecting rod 134 is disposed between the counterbalance mass structure 121 and the teardrop 126. A suitable bearing arrangement as at 136 rotatably supports the connecting rod 134 to the lobe portion 132 of the teardrop. Preferably, means such as a clevis 138 is provided at the first end of the connecting rod 134 to facilitate assembly and disassembly, as may be required for maintenance or system adjustment, of the connecting rod 134 to the lobe portion 132 of the teardrop 126.

Figure 3:
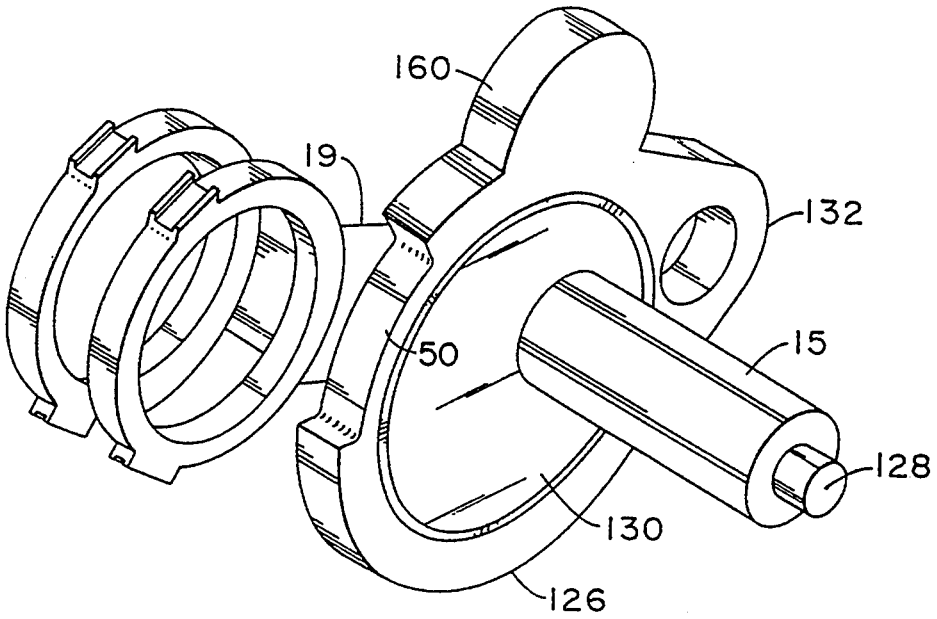
FIG. 3 is a perspective view of the left half of a modified crankshaft showing the teardrop drive member, all according to this invention.
Figure 4:
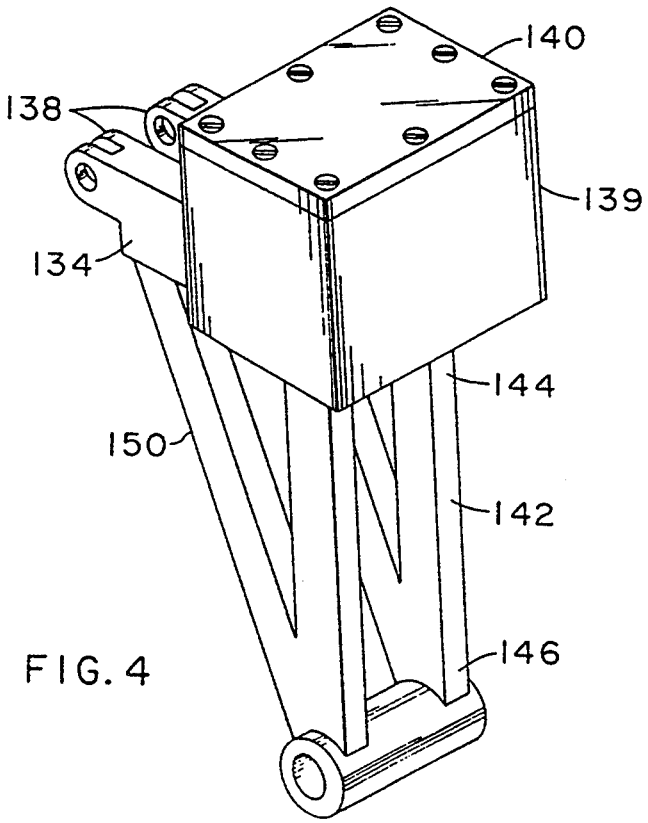
FIG. 4 is a perspective view of the counterbalance structure, with pivot point and connecting rods, all according to this invention.
Figure 5:
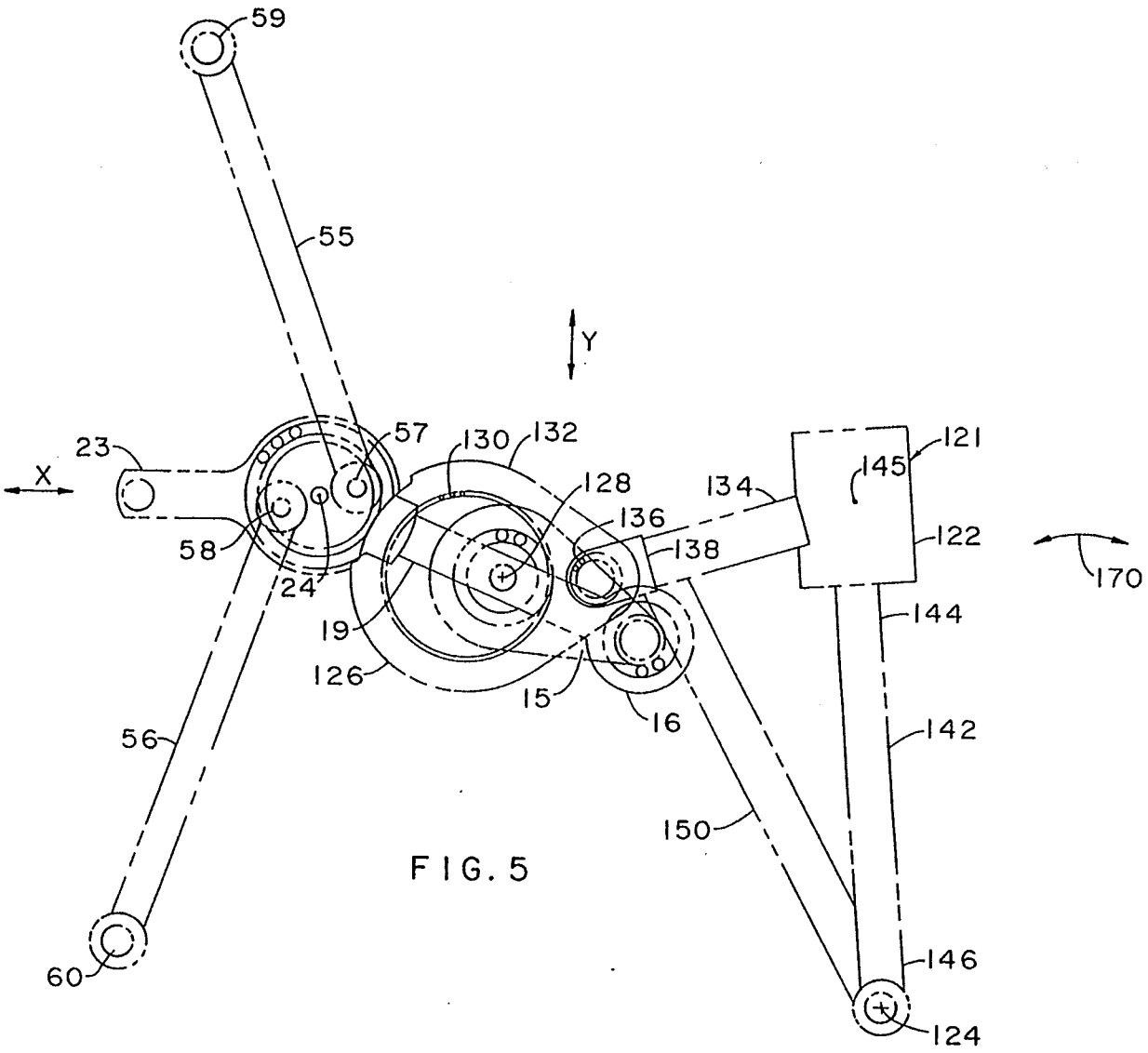
FIG. 5 is a schematic representation of the counterbalance system of this invention, and its relationship with existing elements of a can body maker apparatus, illustrating the X and Y axis motion thereof.

Considering now also FIGS. 3 through 5, the mechanical elements of the invention are described with specific reference to the left half of the system. As is evident in FIGS. 2 and 4, the counterbalance system is connected preferably to both sections of the crankshaft 15.

The counterbalance structure 121 includes an enclosed housing 139 having suitable access to its interior space, such as through a removably secured access port 140, to permit the increase or decrease of the total mass of the counterbalance mass 121 or to modify the mass center of the counterbalance structure 121 relative to the first reference point 124. Additionally, local mass units as at 143 can be positioned at various locations about the housing 139 to adjust the center of mass as well as the total weight of the counterbalance structure. In the preferred embodiment, the counterbalance structure 121 includes a strut 142 having an upper end 144 and a lower end 146. The strut upper end 144 is fixedly attached to the bottom of the housing 139 and supports the counterbalance mass in an elevated position relative to the first reference point 124. The lower end 146 of the strut 142 is mounted for pivotal movement relative to the first reference point 124 by means of a supporting bracket 148 and appropriate bearing means contained therein. The support bracket 148, which defines the first reference point 124 can be located on the bottom portion 114 of the housing 112 in a predetermined location according to certain parameters which will be described below. Additional supporting means such as strut 150 which is fixedly connected to the connecting rod 134 and the lower end 146 of strut 142 can be included in the counterbalance system 110 to enhance the stiffness of the structure. The connecting rod 134, clevis 138, and strut 142 can be integral with the housing 139 or separate components removably attached thereto.

Considering in particular FIG. 5, the eccentrically driven, reciprocating motion having both an X axis and Y axis component as at 170 of a pivoting mass which characterizes the operation of the preferred embodiment of the counterbalance system can be readily appreciated. The rotational movement of the crankshaft 15 about the axis 128, imparts eccentric rotational movement to the teardrop member 126. The counterbalance structure 121 through the connecting rod 134 and clevis 138 is reciprocally pivoted about the first reference (or pivot point) 124. Changes to the distance between the local center of the teardrop member 126 and the location on the lobe portion 132 at which the clevis 138 is attached will change the travel of the system with a resulting change in the acceleration of the counterbalanced mass 122. Likewise, a modification of the local center of the teardrop member relative to the axis 128 of rotation of the crankshaft will permit a phase adjustment of the counterbalance structure 121 relative to the motion of the ram assembly. Preferably, the reciprocal motion of the counterbalance mass is 180 degrees out of phase with the reciprocating ram motion. As the ram moves toward the die to initiate can body formation, the counterbalance mass initiates its rearward movement. The movement of the ram assembly is generally opposite the movement of the counterbalance mass. The ram assembly and the counterbalance mass can be adjusted such that they begin their respective movement away from the crankshaft at the same instant and upon completion of one half of the can body formation cycle begin their respective movement back toward the center of the can body maker machine, (as figuratively represented by the crankshaft axis of rotation 128).

As can be readily appreciated, various aspects of the structural relationship of the counterbalance system can be modified to change the operating characteristics of the counterbalance system itself as well as the operation of the can body maker ram assembly. Initially, when considering the structural form of the counterbalance system, there are three key relationships within the structure which must be evaluated: the pivot connection of the first reference point 124 to the lobe 132 of the teardrop 126; the pivot connection of the first reference point 124 to the center 144 of the mass 122; and variations to the amount of mass in the mass housing 123 which would cause a mass center shift and effect force reaction within the system. Additional modifications and adjustments to the system are possible. For instance, a shift in the eccentric distance of the teardrop causes an amplitude shift in the total oscillation distance and changes acceleration and velocity of the system. Adjustments to the eccentric distance will allow a change of mass in the system. A change in the length between the center distance of the eccentric location and the clevis bearing connection to the counterweight such that the teardrop has a lower or higher oscillatory or maximum angular excursion in the system would result primarily in a reduction of the Y axis, or vertical travel generated in the teardrop member. Changes in the length of the connecting rod 134 modify the Y axis force input in the wave form profile due to the effects of gravity on the counterbalance mass 122. Changes in the teardrop back dead center position relative to the crank back dead center changes the wave form combination between the ram and the mass counterbalance system with up to 180 degrees wave form shift with the resulting combination of the counterbalance mass and the ram forces. It should be appreciated that local geometry within the can body maker apparatus can contribute to and affect the output of the counterbalance system.

Additional modifications to the basic configuration of the crankshaft 15 and teardrop member 126 can be made to contribute to the overall balance of the counterbalance system as well as the function of the redraw system. The crankshaft 15 can be machined to include a lobe, as at 160, to offset the crank arm 16. The teardrop member 126 can also be machined to offset the lobe portion 132. Additionally, the teardrop member 126 can include a cam surface, as at 50, which cooperates with the redraw lever arm 46 and its cam surface 48. It is also possible to modify the mass balance of crankshaft itself. Such a modification would change the local balance of crank system itself and contribute to the tuning of the system. In fact, such a modification could be necessary due to other unique characteristics of the system in order to detune the system or create an imbalance within the system.

The counterbalance mass 122 can be adjustably secured within the housing 139 by means of brackets 141 in order to permit minor adjustments to the mass center of the counterbalance structure 121 without destroying the individual structural components or pivot points within the counterbalance system.

Movement within the can body maker, or Z axis motion, which is perpendicular both to the X axis reciprocating motion of the ram assembly and the Y axis motion of the crankshaft and ram assembly is present in extremely small degrees and as such it has not generated the load imbalances caused by the ram assembly X axis motion. While the discussion of the preferred embodiment of this invention has been directed to a counterbalance system for primarily the X axis and to a lesser, but not insignificant amount, the Y axis motion of the crankshaft system, the instant counterbalance system can be tuned for frequency along the Z axis by adjusting the stiffness of the system through structure modification to the counterbalance structure 121. The structural stiffness of the entire system can be changed in the counterbalance mass or counterbalance structure in order to match frequencies for any type of driving source in which it would be necessary to avoid the natural frequency range of that drive source. For example, the construction of the strut 150 can contribute to the overall stiffness of the counterbalance mass structure through the selection of joining techniques and materials. Alternatively, the structure as now formed by the strut 150 can be replaced with one or more rods or cables attached by turnbuckles or the like between the clevis 138 and the lower portion 146 of the strut 142.

The can body maker has an interface with the supporting floor structure of the manufacturing plant in which it is located. The location of the supporting pads 152 of the can body and their contact with the floor 154, schematically represented in FIG. 1, are the footprints of the system, and their location can vary the entire structure's reaction to the floor. Accordingly, it is preferred that the footprints of the can body maker are selected to provide maximum separation along the X axis. While the counterbalance mass structure has been shown with a redraw can body maker system of the type typically used in the manufacture of aluminum can bodies, the counterbalance system can be employed equally effectively with steel can body makers.

While the invention has been described in terms of preferred embodiments, the claims appended hereto are intended to encompass all embodiments which fall within the spirit of the invention.

What is claimed is:

1. A counterbalance system for use in combination with a can body maker having a frame and ram means mounted in said frame for reciprocal, straight line motion comprising:

(a) a counterbalance system frame attached to said can body maker frame;

(b) a crankshaft mounted in the can body maker frame for rotation about a first axis, said crankshaft effecting the reciprocal motion of said ram means;

(c) a member mounted on said crankshaft for eccentric motion relative to said first axis;

(d) counterbalance mass structure means operatively associated with said member and mounted in said counterbalance system frame for pivotal reciprocal motion relative to a pivot point in the counterbalance system frame; and (e) a mass member adjustably mounted in the counterbalance mass structure means whereby the center of mass of the counterbalance mass structure means is adjustable relative to the pivot point.

2. The counterbalance system according to claim 1 wherein the member mounted on the crankshaft for eccentric rotation relative to the first axis is a teardrop member which includes a lobe which defines the connecting point at which the counterbalance mass structure is attached to the teardrop member, and the distance between the first axis and the connecting point defines the amount of travel of the counterbalance mass structure relative to the pivot point.

3. The counterbalance system according to claim 1 wherein the counterbalance mass structure includes a strut depending therefrom and selectively elevating the counterbalance structure relative to the pivot point.

4. The counterbalance system according to claim 1 wherein the counterbalance mass structure includes a connecting rod by which it is operatively associated with the member mounted on the crankshaft for eccentric rotation relative to the first axis.

5. The counterbalance system according to claim 1 wherein the can body maker apparatus includes a cam operated feature and the member mounted on the crankshaft for eccentric rotation relative to the first axis includes a cam surface adapted to cooperate with the cam operated feature.

6. The counterbalance system according to claim 1 wherein the member mounted on the crankshaft for eccentric rotation relative to the first axis includes means for balancing the member's eccentric rotation about the crankshaft.

7. The counterbalance system according to claim 1 wherein the counterbalance system includes a housing in which the counterbalance mass structure is contained.

8. An apparatus for the manufacture of can bodies comprising:

(a) a frame;

(b) drive mechanism including a crank, said crank adapted to rotate about a first axis and mounted in said frame;

(c) ram means for forming can blanks into elongated can bodies mounted in said frame for reciprocal, straight line motion;

(d) rod means operatively connecting said rotating crank with said ram means for imparting reciprocal motion to said ram means;

(e) a member mounted on said crankshaft for eccentric motion relative to said first axis;

(f) means defining a mass disposed for pivotal reciprocal motion relative to a predetermined point;

(g) an adjustable mass member operatively associated with said means for defining a mass, whereby said adjustable mass member locates the center of mass of the means defining a mass relative to said predetermined point; and (h) means connecting said member mounted on said crankshaft to said mass means whereby the eccentric motion of said member mounted on said crankshaft imparts pivotal reciprocal motion to said mass means in counterbalanced opposition to said ram means.

9. The apparatus of claim 8 wherein the reciprocal motion of the mass is substantially opposite and less than the reciprocating motion of the ram means assembly.

10. In combination with a can body maker apparatus having a power drive means including a crankshaft adapted to rotate about a first axis and a ram means assembly in communication with said crankshaft such that the rotary motion of the crankshaft causes straight line motion in the ram means assembly:

(a) a member mounted on said crankshaft for eccentric movement relative to said first axis;

(b) means defining a mass disposed for reciprocal, pivotal motion about a pivot point in said can body maker apparatus, said mass means including a mass member for adjusting the center of mass of said mass means; and (c) means connecting said member mounted on said crankshaft to said mass means whereby the eccentric motion of said member mounted on said crankshaft imparts reciprocal pivotal motion to said mass means.

11. The combination of claim 10 wherein the reciprocal motion of the mass is substantially opposite and less than the reciprocating motion of the ram means assembly.

12. In combination with a can body maker apparatus having a power drive means for actuating a ram means assembly in reciprocal straight line motion: means defining a mass disposed for reciprocal motion relative to a predetermined pivot point in the can body maker apparatus, a mass member adjustable relative to said means defining a mass, whereby the center of mass of said means defining a mass is adjustable relative to said predetermined point, and motive means for imparting the reciprocal motion to said mass means, whereby the reciprocal, pivotal motion of said mass is substantially opposite the straight line motion of the ram means assembly.

13. The combination according to claim 12 wherein the reciprocal, pivotal motion of the mass includes a component which is substantially perpendicular to the straight line motion of the ram means.

14. An apparatus for the manufacture of can bodies comprising:

(a) a frame;

(b) drive mechanism mounted in said frame and including a crank for rotation about a first axis;

(c) a straight line motion assembly including side thrust resisting upper and lower swing levers operatively connected between said straight line motion assembly and said frame;

(d) rod means operatively connecting said rotating crank with said straight line motion assembly for imparting reciprocal motion to said straight line motion assembly;

(e) ram means for forming can blanks into elongated can bodies mounted in said straight line motion assembly;

(f) an eccentric member mounted on said crankshaft for eccentric motion relative to said first axis;

(g) means defining a mass disposed for pivotal reciprocal motion relative to a predetermined second pivot point;

(h) a mass member adjustably mounted in said means defining a mass so as to position the center of mass of said means defining a mass relative to the predetermined second pivot point; and (i) means connecting said eccentric member on said crankshaft to said mass means whereby the eccentric motion of said eccentric member imparts reciprocal motion to said mass means about said second pivot point in counterbalanced opposition to said straight line motion assembly.

15. An apparatus for the manufacture of can bodies comprising:

(a) a frame;

(b) drive mechanism including a crank rotating about a first axis mounted in said frame;

(c) a straight line motion assembly mounted for reciprocal travel along an X axis of said frame;

(d) side thrust resisting upper and lower swing levers operatively connected between said straight line motion assembly and said frame to dampen horizontal movement of said straight line motion assembly along a Z axis of said frame;

(e) rod means operatively connecting said rotating crank with said straightline motion assembly for imparting reciprocal motion to said straight line motion assembly;

(f) ram means for forming can blanks into elongated can bodies mounted in said straight line motion assembly;

(g) an eccentric member mounted on said crankshaft for eccentric motion relative to said first axis, said member having a first pivot point thereon;

(h) means defining an adjustable mass disposed for pivotal reciprocal motion relative to a predetermined second pivot point; and (i) means connecting said eccentric member on said crankshaft to said mass means whereby the eccentric motion of said eccentric member imparts reciprocal motion to said mass means about said second pivot point in counterbalanced opposition to said straight line motion assembly and to dampen vertical movement of the straight line motion assembly along a Y axis of said frame.

16. Apparatus for manufacturing can bodies comprising:

a frame;

a drive mechanism mounted in said frame and including a rotatable crank having an axis of rotation;

a ram which is connected to said crank and which is adapted to reciprocate on a horizontal axis to a form and wall iron elongated can bodies;

means interconnecting said ram with said frame to guide said ram in a straight line along its axis and resist side motion thereof;

an eccentric member mounted on said crank for eccentric motion relative to said axis of rotation;

a counterbalance mass mounted in said frame and adapted to pivot about a pivot point locate din a vertical plane through said horizontal axis of said ram and offset vertically with respect to such axis;

a mass member adjustably mounted in said counterbalance mass for adjusting the center of mass of said counterbalance mass relative to said pivot point; and a connecting link between said eccentric member and said mass whereby eccentric movement of said eccentric member imparts reciprocal motion to said mass about said pivot point in the vertical plane of said ram and in which the horizontal component of said reciprocal motion in greater than said vertical component.

17. Apparatus as set forth in claim 16 in which said means for guiding said ram in a straight line includes upper and lower swing levers interconnecting said ram and said frame.

18. Apparatus as set forth in claim 16 in which said pivot point is located below said counterbalance mass.

* * * * *